US008464916B2

(12) United States Patent
De Rosa

(10) Patent No.: US 8,464,916 B2
(45) Date of Patent: Jun. 18, 2013

(54) ANTI-DRIP CAP WITH AN ELASTICALLY RETURNED MOBILE COVER

(75) Inventor: Daniel De Rosa, Louviers (FR)

(73) Assignee: Maitrise et Innovation, Val de Reuil (FR)

( * ) Notice: Subject to any disclaimer, the term of this patent is extended or adjusted under 35 U.S.C. 154(b) by 49 days.

(21) Appl. No.: 13/320,935

(22) PCT Filed: May 10, 2010

(86) PCT No.: PCT/EP2010/056354

§ 371 (c)(1),
(2), (4) Date: Nov. 17, 2011

(87) PCT Pub. No.: WO2010/133467

PCT Pub. Date: Nov. 25, 2010

(65) Prior Publication Data

US 2012/0055900 A1 Mar. 8, 2012

(30) Foreign Application Priority Data

May 18, 2009 (FR) ..... 09 53279

(51) Int. Cl.
*B67D 3/00* (2006.01)

(52) U.S. Cl.
USPC ..... 222/513; 222/519

(58) Field of Classification Search
USPC ..... 222/513, 519–522, 546, 153.11, 222/108; 215/320, 329, 334, 335, 265, 272, 215/276
See application file for complete search history.

(56) References Cited

U.S. PATENT DOCUMENTS

| | | | | |
|---|---|---|---|---|
| 4,690,304 | A * | 9/1987 | Morel | 222/44 |
| 4,817,831 | A * | 4/1989 | Theisen | 222/499 |
| 5,004,127 | A * | 4/1991 | Morel | 222/521 |
| 5,713,493 | A * | 2/1998 | Garibaldi | 222/153.06 |
| 7,641,065 | B2 * | 1/2010 | Wang Wu | 215/387 |
| 2002/0046983 | A1 * | 4/2002 | Shin et al. | 215/276 |
| 2004/0118873 | A1 * | 6/2004 | Foster et al. | 222/153.14 |
| 2010/0230376 | A1 | 9/2010 | De Rosa et al. | |

FOREIGN PATENT DOCUMENTS

| | | |
|---|---|---|
| CH | 426 534 | 12/1966 |
| EP | 0 391 688 | 10/1990 |
| FR | 2 922 527 | 4/2009 |

OTHER PUBLICATIONS

International Search Report dated Aug. 6, 2010, corresponding to PCT/EP2010/056354.

* cited by examiner

*Primary Examiner* — Lien Ngo
(74) *Attorney, Agent, or Firm* — Young & Thompson

(57) ABSTRACT

The invention relates to a so-called "anti-drip" cap (10) for a flexible bottle (12) including a base (16), in communication with the bottle, covered by a cover (26), including an outlet opening (30), the cover (26) being movable between a bottom blocking position and a top dispensing position, characterized in that the cover (26) is mobile between a first angular position associated with the bottom blocking position and a second angular position, in which the cover (26) is mobile under the pressure of a product feeding the base, between an intermediate position for venting the bottle (12) and the top dispensing position, an elastic return element (38) with a predetermined stiffness being inserted in the second angular position between the cover and the base.

20 Claims, 4 Drawing Sheets

ANTI-DRIP CAP WITH AN ELASTICALLY RETURNED MOBILE COVER

The invention relates to a so-called "anti-drip" cap for a deformable bottle.

The invention relates more particularly to a cap for a deformable bottle, notably a flexible bottle, containing a cosmetic, pharmaceutical, industrial or food product in liquid or cream form, including:

- a substantially tubular base that is adapted to be fixed and sealed to a complementary tubular neck of the bottle and an "upper" transverse wall of which includes at least one inlet orifice communicating with the neck of the bottle,
- a substantially tubular cover that caps the base in sealed manner and an "upper" transverse face wall of which includes at least one product outlet orifice, the cover and the base defining a sealed chamber through which the product passes disposed between the inlet orifice of the base and the product outlet orifice, the cover being mobile vertically between at least:

- a low blocking and locking position in which the cover is locked onto the base and in which the product outlet orifice is lowered over a blocking member that projects coaxially from the upper transverse wall of the base, said blocking member blocking the product outlet orifice,
- a high dispensing position in which the outlet orifice is disposed with a particular high clearance above the blocking member to allow the product to pass through the inlet and outlet orifices and the chamber.

Numerous examples of caps of this type are known.

One such cap is routinely used in the cosmetics or foodstuffs industry for dispensing a cream product.

Such a cap nevertheless has the drawback of having only a low blocking position or a high dispensing position.

Thus such a cap necessitates manipulation to open it each time that it is used as otherwise the product that it contains dries out and blocks the product outlet orifice.

Moreover, such a cap cannot remain in the high dispensing position without the risk of being overturned and the product that it contains flowing out of it.

The invention remedies this drawback by proposing an anti-drip cap in which the product outlet orifice is opened only when the cap is fed with product, for example when pressure is exerted on a flexible bottle onto which the cap is screwed.

To this end, the invention proposes an anti-drip cap of the type described above, characterized in that the cover is mounted to be pivoted manually between:

- a first angular position in which the cover is locked in the lower blocking and locking position by an upper abutment integral with the base,
- a second angular position in which the cover, released from the abutment, is vertically mobile between at least:
  - an intermediate position in which the cover is disposed at a distance from the base equal to a small clearance to allow the product outlet orifice, which is disposed at a distance from the blocking member equal to said small clearance, to vent the bottle,
  - the high dispensing position in which the cover is disposed at a distance from the base equal to the particular high clearance to allow the product outlet orifice, which is disposed at a distance from the blocking member equal to said high clearance, to allow the product to pass through the inlet and outlet orifices and the chamber, elastic means of particular stiffness being disposed in the second angular position between the cover and the base to allow the cover to be returned toward its vertical intermediate position and to allow raising of the cover toward its high dispensing position as soon as product injected from the neck of the bottle exerts sufficient pressure on the upper wall of the chamber for the resulting force to overcome the force of said elastic return means.

According to other features of the invention:

- an interior tubular bearing surface of the cover includes at least one first member projecting radially toward the interior of the cover that is adapted to cooperate with an upper abutment projecting radially from the exterior of the base,
- an interior tubular bearing surface of the cover includes at least one second member projecting radially toward the interior of the cover that is adapted to cooperate with a ramp that extends around a lower end of the base over an angular sector corresponding to the angle formed between the first and second angular positions to urge the cover from its low blocking and locking position to its intermediate position,
- an interior tubular bearing surface of the cover includes at least one third member projecting radially toward the interior of the cover that is adapted, in the second angular position, to cooperate with a vertically flexible leaf spring disposed at the periphery of the base to form the elastic return means of particular stiffness,
- the interior tubular bearing surface of the cover includes at least one peg that constitutes the first, second and third members projecting radially toward the interior of the cover,
- the periphery of the base receives a ring that carries at least one upper abutment and one leaf spring,
- the interior tubular bearing surface of the cover includes at least two diametrically opposite pegs, the base includes two diametrically opposite ramps and the ring includes two upper abutments and two leaf springs diametrically opposite in pairs,
- the ring includes a cylindrical tubular section that includes means for vertical immobilization on the base and from which extend vertically two diametrically opposite vertical tabs each of which has a lower edge with a lower transverse face that constitutes the upper abutment,
- the ring includes two elastic leaves made in one piece with the ring that extend around the periphery of the base, a first end of each leaf extending the lower edge of each tab of the ring and a free second end of each leaf being curved with its concave side facing toward the lower end of the base to immobilize the associated peg of the cover in the second angular position,
- the means for vertically immobilizing the ring on the base include:
  - a lower edge of the cylindrical tubular section of the ring that is adapted to rest on a complementary upper face of a flange section projecting radially from the base,
  - an interior bead of the cylindrical tubular section of the ring having a lug-shaped section that is adapted to cooperate with an exterior bead that projects at the periphery of the base and that has a complementary lug-shaped section,
- the blocking member is substantially frustoconical,
- the base includes at least two half-moon-shaped openings regularly circumferentially distributed around the blocking member and each of which forms an inlet orifice,
- a lower end of the base and the cylindrical section of the ring each include an exterior cylindrical bearing surface adapted to cooperate with the tubular interior bearing surface of the cover to guide it vertically.

Other features and advantages of the invention will become apparent on reading the following detailed description, for an understanding of which see the appended drawings, in which.

In the following description, identical reference numbers designate parts that are identical or have similar functions.

Figure 1:
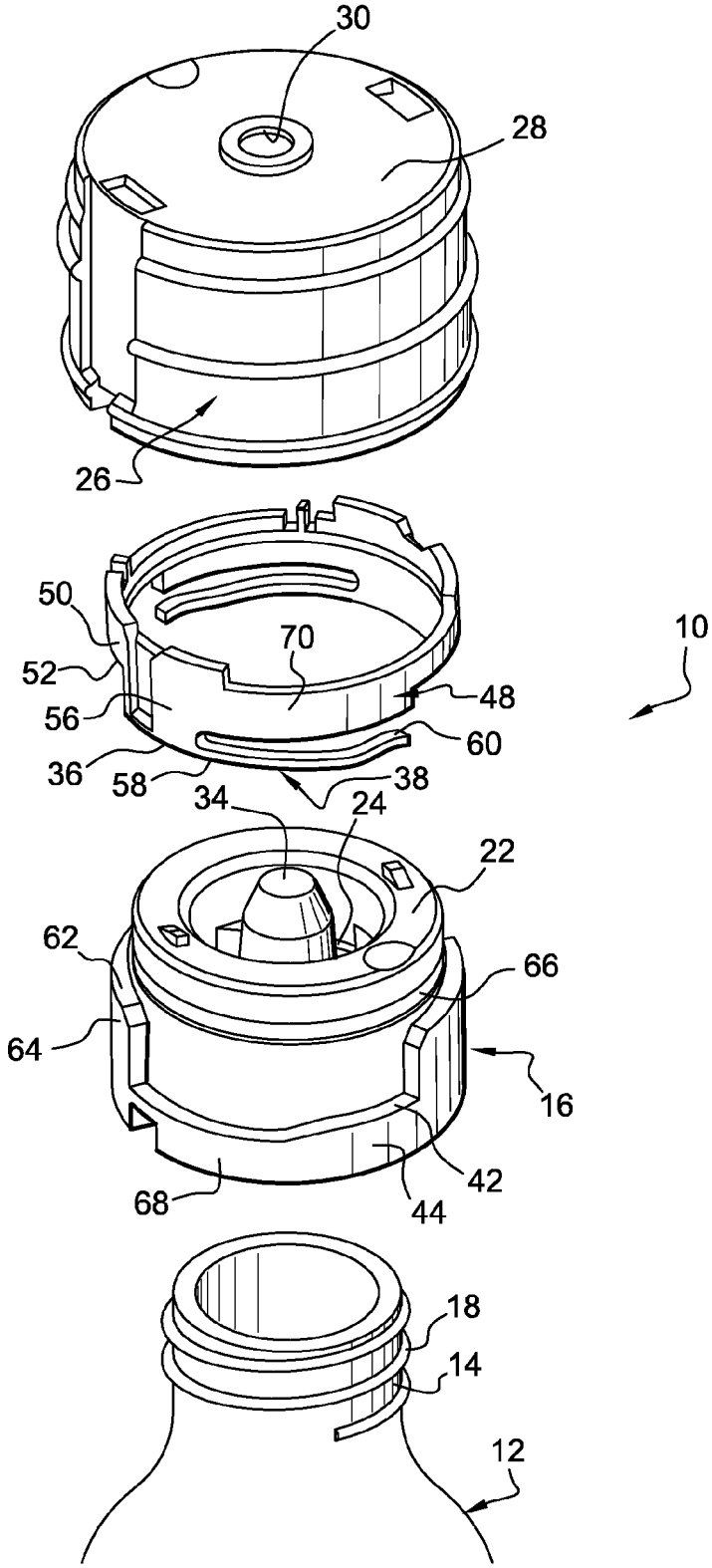
FIG. 1 is an exploded perspective view of an anti-drip cap of the invention.

There is shown in the figures a so-called "anti-drip" cap 10 produced in accordance with the invention.

In known manner, the cap 10 is adapted to equip a deformable bottle 12 of a cosmetic, pharmaceutical, industrial or food product in liquid or cream form.

It will therefore be understood that the range of applications of the cap 10 encompasses highly varied fields.

The deformable bottle 12 may in particular be a rigid bottle one wall of which is mobile. This type of bottle is widely known in the prior art and is used to contain toothpaste, for example.

In such a bottle, the volume of the bottle varies as it is used, because movement of the mobile wall accompanies emptying of the product. In this case the volume of the bottle is always completely filled with product.

The bottle 12 may equally be a flexible bottle that is adapted to be pressed to expel the product.

In such a bottle, the volume of the bottle is globally invariant, the product that is expelled from the bottle being replaced by air when the pressure exerted on the bottle is released.

In the remainder of the present description the invention will be explained with reference to a flexible bottle 12, but it will be understood that this must not be construed as limiting the invention.

The bottle 12 has a neck 14. In known manner, the cap 10 includes a substantially tubular base 16 that is adapted to be fixed and sealed to the complementary tubular neck 14 of the bottle 12.

For example, and this is not limiting on the invention, the neck 14 of the bottle 12 includes a screwthread 18 adapted to receive a complementary internal screwthread 20 of the base 16.

Figure 3:
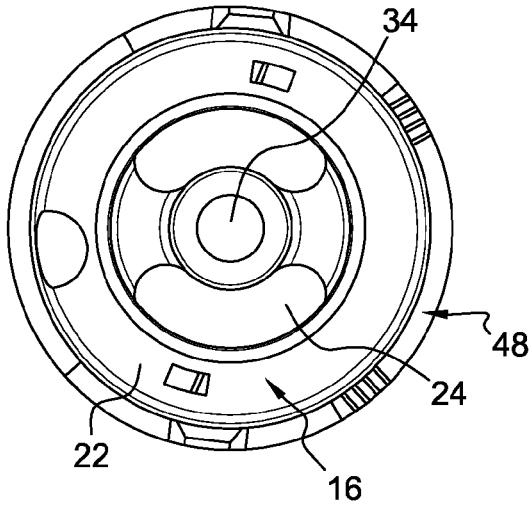
FIG. 3 is a view from above of the base and the ring.

As FIGS. 1 and 3 show more particularly, a so-called "upper" transverse wall 22 of the base includes at least one inlet orifice 24 that is adapted to communicate with the neck 14 of the bottle 12.

The base 16 receives a substantially tubular cover 26 that caps and seals the base 16 and a so-called "upper" transverse face wall 28 of which includes at least one product outlet orifice 30.

Figure 4:
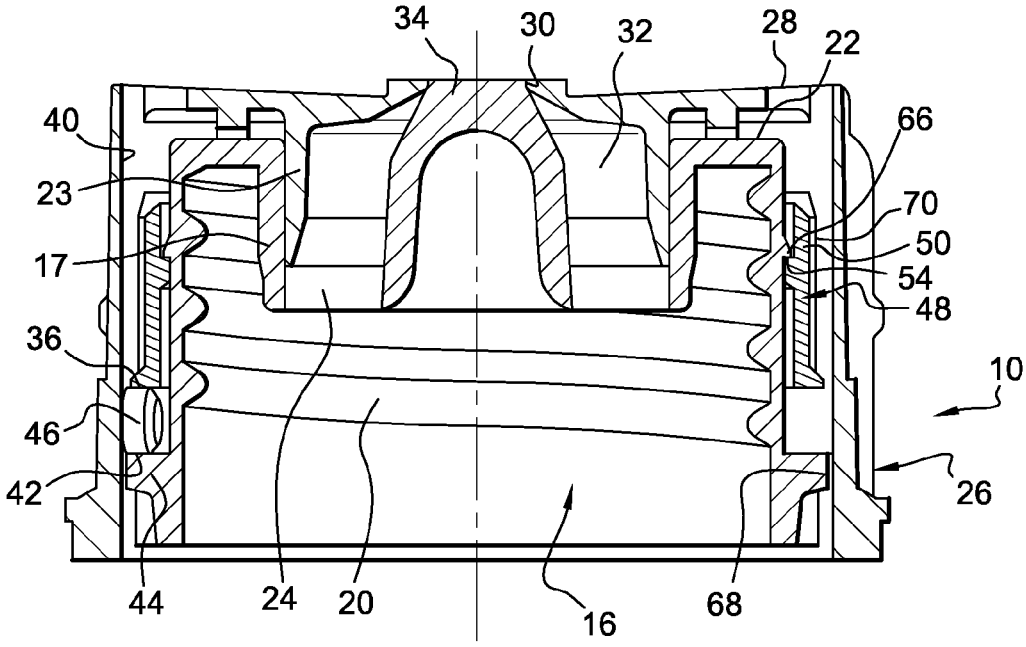
FIG. 4 is a view in section of the cap in the first angular position of the cover associated with its low blocking and locking position.
Figure 5:
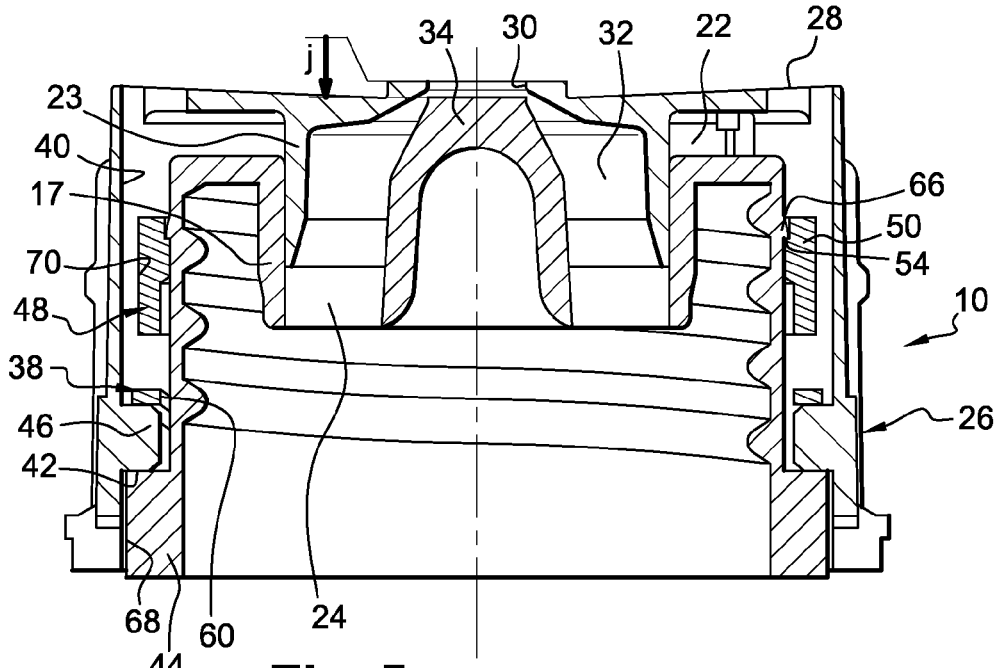
FIG. 5 is a view in section of the cap in the second angular position of the cover associated with its intermediate position for venting the bottle.
Figure 6:
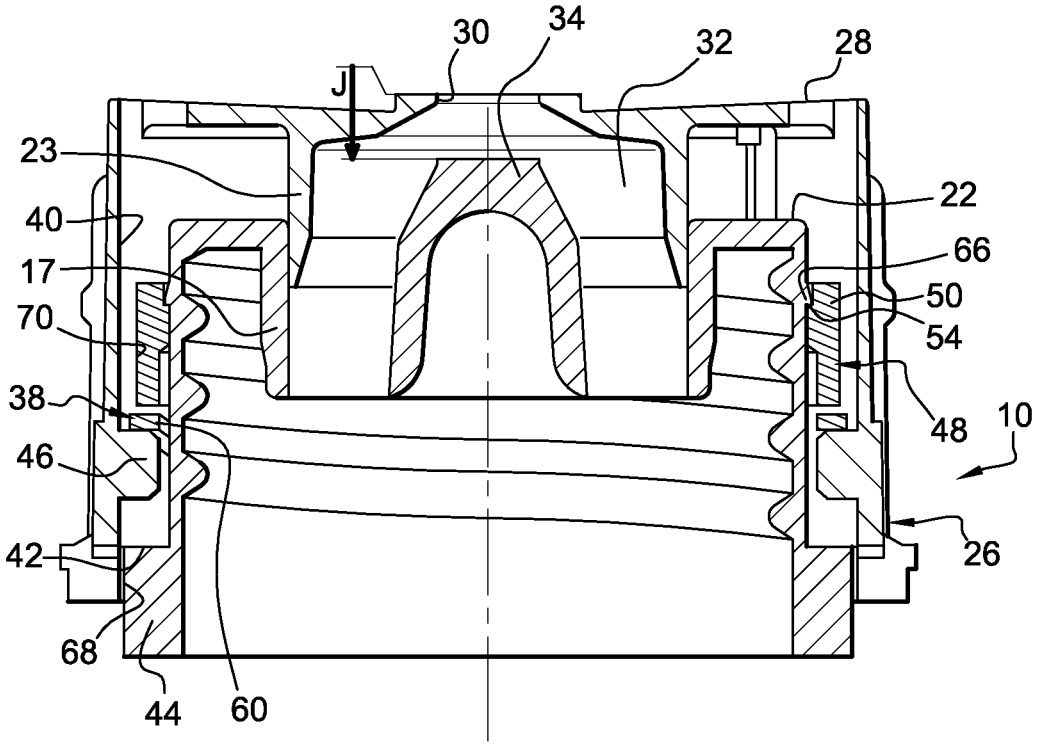
FIG. 6 is a view in section of the cap in the second angular position of the cover associated with its high dispensing position.

Accordingly, as FIGS. 4 to 6 show, the cover 26 and the base 16 define a sealed chamber 32 through which the product passes disposed between the inlet orifice 24 of the base 16 and the product outlet orifice 30.

In the preferred embodiment of the invention the upper wall 22 of the base 16 includes a tubular well 17 that extends vertically toward the neck 14 of the bottle 12 and at the bottom of which the inlet orifice 24 is provided. This well 17 receives a sliding tubular chimney 23 that extends from the transverse wall 28 of the cover 26, said chimney incorporating the outlet orifice 30 at its upper end.

As a result the tubular well 17 and the tubular chimney 23 define a perfectly sealed chamber 32.

It will nevertheless be understood that this disposition is not limiting on the invention and that any configuration defining such a chamber 32 between the base 16 and the cover 26 may be suitable for correct implementation of the invention.

In known manner, the cover 26 is vertically mobile between at least one low blocking and locking position, shown in FIG. 4, in which the cover 26 is locked onto the base 16 and the product outlet orifice 30 is lowered over a blocking member 34 that projects coaxially with the base 16 from its upper transverse wall 22, said blocking member 34 blocking the product outlet orifice 30, and a high dispensing position, shown in FIG. 6, in which the outlet orifice 30 is disposed with a particular high clearance "J" above the blocking member 34 to allow the product to pass through the inlet orifice 24, the outlet orifice 30 and the chamber 32.

A known disadvantage of such a cap is that it cannot remain in the high dispensing position without the risk of being overturned and the product that it contains flowing out of it.

The invention remedies this drawback by proposing an anti-drip cap in which the product outlet orifice 30 is uncovered only when the cap 10 is fed with product, for example when pressure is exerted on the flexible bottle 12 onto which the cap 10 is screwed.

To this end, the invention proposes an anti-drip cap 10 of the type described above characterized in that the cover 26 is mounted to pivot between two angular positions that are shown on the one hand in FIG. 4 and on the other hand in FIGS. 5 and 6.

In the first angular position shown in FIG. 4, the cover 26 is locked in the low blocking and locking position by an upper abutment 36 integral with the base 16.

In the second angular position shown in FIGS. 5 and 6, the cover 26, released from the abutment 36, is vertically mobile between at least one intermediate position shown in FIG. 5 in which the cover 26 is disposed with a small clearance "j" relative to the base 16 to allow the product outlet orifice 30, which is at a distance from the blocking member 34 equal to said small clearance, to vent the associated bottle, and the high dispensing position shown in FIG. 6 in which the cover is disposed at a distance from the base 16 equal to the particular high clearance "J" to allow the product outlet orifice 30, which is at a distance from the blocking member 34 equal to said high clearance "J", to allow the product to pass through the inlet orifice 24, the outlet orifice 30 and the chamber 32.

As FIG. 3 shows, it will be noted that, to this end, the blocking member 34 is substantially frustoconical and coaxial with the base 16. The base 16 includes at least two half-moon-shaped openings 24 regularly circumferentially distributed around the blocking member 34 and each of which forms an inlet orifice 24.

A particularly significant advantage of the invention is that in the second angular position the movement from the intermediate position for venting the bottle to the high position for dispensing the product is brought about by the pressure of the product itself, while the reverse movement from the high dispensing position to the intermediate position for venting the bottle is brought about by elastic return means.

Figure 2:
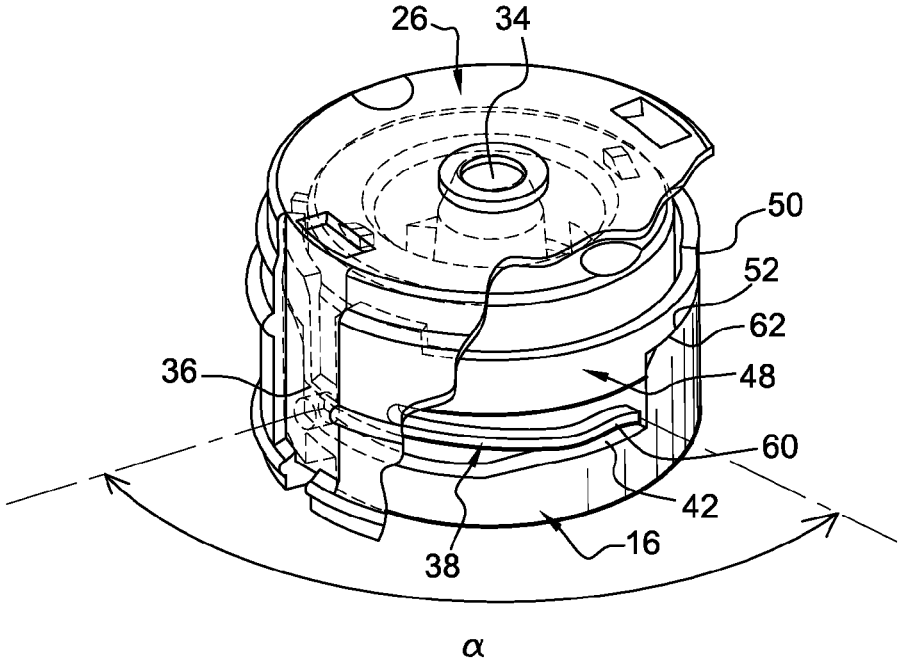
FIG. 2 is an assembled perspective view of an anti-drip cap of the invention partly cut away.

Accordingly, as FIGS. 1 and 2 show, in the second angular position elastic means 38 of particular stiffness are disposed between the cover 26 and the base 16.

The elastic means 38 urge the cover 26 toward its vertical intermediate position shown in FIG. 5.

Moreover, the particular stiffness of the elastic means allows raising of the cover 26 toward its high dispensing position shown in FIG. 6 as soon as product is injected from the neck of the bottle, thus penetrating via the inlet orifice 24 into the chamber 32 to exert on the upper wall 28 of the chamber 32 sufficient pressure for the resulting force to overcome the force of said elastic return means 38 and raise the cover 26, so that the orifice 30 is disposed at a distance from the blocking member 34 equal to the clearance "J".

To achieve this configuration, an interior tubular bearing surface 40 of the cover 26 includes at least one first member projecting radially inwards from the cover 26. This member is adapted to cooperate with an upper abutment 36 projecting radially outward from the base.

Moreover, as FIG. 2 shows, the interior tubular bearing surface 40 of the cover 26 includes at least one second member projecting radially toward the interior of the cover 26 that is adapted to cooperate with a ramp 42 that extends around a lower end 44 of the base 16 over an angular sector "$\alpha$" corresponding to the angle formed between the first and second angular positions to urge the cover 26 from its low blocking and locking position to its intermediate position.

Finally, the interior tubular bearing surface 40 of the cover includes at least one third member projecting radially toward the interior of the cover 26 that is adapted, in the second angular position, to cooperate with a vertically flexible leaf spring 38 provided at the periphery of the base 16 to form the elastic return means of particular stiffness.

It will be understood that these first, second and third members could be decoupled from each other. However, for simplicity, the interior tubular bearing surface 40 of the cover includes at least one peg 46 that constitutes the first, second and third members projecting radially inwards from the cover 26.

As described above, the ramp 42 is arranged around a lower end 44 of the base 16. As the base is preferably produced in a plastic material, this ramp 42 is preferably molded in one piece with the base 16.

In a similar way, the upper abutment 36 and the leaf spring 38 could be molded in one piece with the base 16.

However, with the aim of simplifying the manufacture of the cap 10 from components that may be simply produced by injection molding a plastic material, the periphery of the base 16 receives a ring 48 that carries at least one upper abutment 36 and a leaf spring 38.

For reasons of symmetry and in order to balance the forces to which the cover 26 is subjected, in the preferred embodiment of the invention the interior tubular bearing surface 40 of the cover 26 includes at least two diametrically opposite pegs 46, the base 16 includes two diametrically opposite ramps 42, and the ring 48 includes two upper abutments 38 and two leaf springs 38 diametrically opposite in pairs.

As FIGS. 1, 2 and 4 to 6 show, the ring 48 includes a cylindrical tubular section 50 that includes means 52, 54 for vertical immobilization on the base 16 and from which extend vertically two diametrically opposite vertical tabs 56 each of which has a lower edge with a lower transverse face 38 that constitutes the upper abutment.

Moreover, two elastic leaves constituting the leaf spring 38 are molded in one piece with the ring 48.

The leaves 38 extend around the periphery of the base 16. A first end 58 of each leaf extends the lower edge of each tab 56 of the ring and a free second end 60 of each leaf 38 is curved with its concave side facing toward the lower end 42 of the base 16 to immobilize the associated peg 46 of the cover 26 in the second angular position, as shown in FIGS. 1 and 6.

Any known prior art means could be used to immobilize the ring 48 axially on the base 16. Thus the ring could be crimped, welded or glued on.

However, in the preferred embodiment of the invention, the means for vertically immobilizing the ring 48 on the base include a lower edge 52 of the cylindrical tubular section 50 of the ring 48 that is adapted to rest on a complementary upper face 62 of a flange section 64 projecting radially from the base 16. This upper face opposes downward movement of the ring 48.

The means for vertically immobilizing the ring 48 on the base also include an interior bead 54 on the cylindrical tubular section 50 of the ring, having a lug-shaped section, which is adapted to cooperate with an exterior bead 66 that projects from the periphery of the base 16 and has a complementary lug-shaped section.

Finally, it will be understood that the ring 48 makes it possible to provide a function of guiding the cover 26. Indeed, the lower end 44 of the base 16 and the cylindrical section 50 of the ring 48 comprise respective exterior cylindrical bearing surfaces 68, 70 adapted to cooperate with the interior tubular bearing surface 40 of the cover 26 to guide it vertically.

Thus the invention proposes an anti-drip cap 10 that is particularly innovative in that it makes it possible to prevent the product leaking and drying out and advantageous in that it is formed of a limited number of parts and can therefore be mass produced at low cost.

The invention claimed is:

1. An "anti-drip" cap (10) for a deformable bottle (12), notably a flexible bottle, containing a cosmetic, pharmaceutical, industrial or food product in liquid or cream form, including:

a substantially tubular base (16) that is adapted to be fixed and sealed to a complementary tubular neck (14) of the bottle (12) and an "upper" transverse wall (22) of which includes at least one inlet orifice (24) communicating with the neck (14) of the bottle (12), a substantially tubular cover (26) that caps the base (16) in sealed manner and an "upper" transverse face wall (28) of which includes at least one product outlet orifice (30), the cover (26) and the base (16) defining a sealed chamber (32) through which the product passes disposed between the inlet orifice (24) of the base (16) and the product outlet orifice (30), said cover (26) being mobile vertically between at least:

a low blocking and locking position in which the cover (26) is locked onto the base (16) and in which the product outlet orifice (30) is lowered over a blocking member (34) that projects coaxially from the upper transverse wall (22) of the base (16), said blocking member (34) blocking the product outlet orifice (30), a high dispensing position in which the outlet orifice (30) is disposed with a particular high clearance (J) above the blocking member (34) to allow the product to pass through the inlet orifice (24), the outlet orifice (30) and the chamber (32), characterized in that the cover (26) is mounted to be pivoted manually between:

a first angular position in which the cover (26) is locked in the lower blocking and locking position by an upper abutment (36) integral with the base (16), a second angular position in which the cover (26), released from the abutment (36), is vertically mobile between at least:

an intermediate position in which the cover (26) is disposed at a distance from the base (16) equal to a small clearance (j) to allow the product outlet orifice (30), which is disposed at a distance from the blocking member (34) equal to said small clearance (j), to vent the bottle (12), the high dispensing position in which the cover (26) is disposed at a distance from the base (16) equal to the particular high clearance (J) to allow the product outlet orifice (30), which is disposed at a distance from the blocking member (34) equal to said high clearance (J), to allow the product to pass through the inlet orifice (24), the outlet orifice (30) and the chamber, elastic means (38) of particular stiffness being disposed in the second angular position between the cover (26) and the base (16) to allow the cover (26) to be returned toward its vertical intermediate position and to allow raising of the cover (26) toward its high dispensing position as soon as product injected from the neck (14) of the bottle (12) exerts sufficient pressure on the upper wall (28) of the chamber (32) for the resulting force to overcome the force of said elastic return means (38).

2. The cap (10) as claimed in claim 1, characterized in that an interior tubular bearing surface (40) of the cover (26) includes at least one first member projecting radially toward the interior of the cover (26) that is adapted to cooperate with an upper abutment (36) projecting radially from the exterior of the base.

3. The cap (10) as claimed in claim 2, characterized in that an interior tubular bearing surface (40) of the cover (26) includes at least one second member projecting radially toward the interior of the cover (26) that is adapted to cooperate with a ramp (42) that extends around a lower end (44) of the base (16) over an angular sector ($\alpha$) corresponding to the angle formed between the first and second angular positions to urge the cover (26) from its low blocking and locking position to its intermediate position.

4. The cap (10) as claimed in claim 3, characterized in that an interior tubular bearing surface (40) of the cover (26) includes at least one third member projecting radially toward the interior of the cover (26) that is adapted, in the second angular position, to cooperate with a vertically flexible leaf spring (38) disposed at the periphery of the base to form the elastic return means (38) of particular stiffness.

5. The cap (10) as claimed in claim 4, characterized in that the interior tubular bearing surface (40) of the cover (26) includes at least one peg (46) that constitutes the first, second and third members projecting radially toward the interior of the cover (26).

6. The cap (10) as claimed in claim 4, characterized in that the periphery of the base (16) receives a ring (48) that carries at least one upper abutment (36) and one leaf spring (38).

7. The cap (10) as claimed in claim 5, wherein the periphery of the base (16) receives a ring (48) that carries at least one upper abutment (36) and one leaf spring (38); and wherein the interior tubular bearing surface (40) of the cover (26) includes at least two diametrically opposite pegs (46), the base (16) includes two diametrically opposite ramps (42) and the ring (48) includes two upper abutments (36) and two leaf springs (38) diametrically opposite in pairs.

8. The cap (10) as claimed in claim 7, characterized in that the ring (48) includes a cylindrical tubular section (50) that includes means (52, 54) for vertical immobilization on the base (16) and from which extend vertically two diametrically opposite vertical tabs (56) each of which has a lower edge with a lower transverse face (38) that constitutes the upper abutment.

9. The cap (10) as claimed in claim 8, characterized in that the ring (48) includes two elastic leaves constituting the leaf springs (38), made in one piece with the ring (48), that extend around the periphery of the base (16), a first end (58) of each leaf (38) extending the lower edge of each tab (56) of the ring (48) and a free second end (60) of each leaf (38) being curved with its concave side facing toward the lower end of the base to immobilize the associated peg (46) of the cover (26) in the second angular position.

10. The cap (10) as claimed in claim 8, characterized in that the means for vertically immobilizing the ring (48) on the base (16) include:

a lower edge (52) of the cylindrical tubular section (50) of the ring (48) that is adapted to rest on a complementary upper face (62) of a flange section (64) projecting radially from the base (16), an interior bead (54) of the cylindrical tubular section (50) of the ring having a lug-shaped section that is adapted to cooperate with an exterior bead (66) that projects at the periphery of the base and that has a complementary lug-shaped section.

11. The cap (10) as claimed in claim 1, characterized in that the blocking member (34) is substantially frustoconical.

12. The cap (10) as claimed in claim 1, characterized in that the base includes at least two half-moon-shaped openings (24) regularly circumferentially distributed around the blocking member and each of which forms an inlet orifice.

13. The cap (10) as claimed in claim 8, characterized in that a lower end (44) of the base (16) and the cylindrical section (50) of the ring (48) each include an exterior cylindrical bearing surface (68, 70) adapted to cooperate with the tubular interior bearing surface (40) of the cover (26) to guide it vertically.

14. The cap (10) as claimed in claim 2, wherein an interior tubular bearing surface (40) of the cover (26) includes at least one second member projecting radially toward the interior of the cover (26) that is adapted to cooperate with a ramp (42) that extends around a lower end (44) of the base (16) over an angular sector ($\alpha$) corresponding to the angle formed between the first and second angular positions to urge the cover (26) from its low blocking and locking position to its intermediate position.

15. The cap (10) as claimed in claim 2, wherein an interior tubular bearing surface (40) of the cover (26) includes at least one third member projecting radially toward the interior of the cover (26) that is adapted, in the second angular position, to cooperate with a vertically flexible leaf spring (38) disposed at the periphery of the base to form the elastic return means (38) of particular stiffness.

16. The cap (10) as claimed in claim 3, wherein an interior tubular bearing surface (40) of the cover (26) includes at least one third member projecting radially toward the interior of the cover (26) that is adapted, in the second angular position, to cooperate with a vertically flexible leaf spring (38) disposed at the periphery of the base to form the elastic return means (38) of particular stiffness.

17. The cap (10) as claimed in claim 9, wherein the means for vertically immobilizing the ring (48) on the base (16) include:

a lower edge (52) of the cylindrical tubular section (50) of the ring (48) that is adapted to rest on a complementary upper face (62) of a flange section (64) projecting radially from the base (16), an interior bead (54) of the cylindrical tubular section (50) of the ring having a lug-shaped section that is adapted to cooperate with an exterior bead (66) that projects at the periphery of the base and that has a complementary lug-shaped section.

18. The cap (10) as claimed in claim 2, wherein the blocking member (34) is substantially frustoconical.

19. The cap (10) as claimed in claim 3, wherein the blocking member (34) is substantially frustoconical.

20. The cap (10) as claimed in claim 4, wherein the blocking member (34) is substantially frustoconical.

* * * * *